US006443379B2

(12) United States Patent
Lassmann

(10) Patent No.: US 6,443,379 B2
(45) Date of Patent: Sep. 3, 2002

(54) METHOD FOR PRODUCING A CHEESE, AND A CHEESE SO PRODUCED

(75) Inventor: Manfred Lassmann, Nettetal (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/838,906

(22) Filed: Apr. 20, 2001

(30) Foreign Application Priority Data

Apr. 20, 2000 (DE) ..... 100 19 734
Jul. 6, 2000 (DE) ..... 100 33 015

(51) Int. Cl.[7] ..... B65H 55/04; B65H 54/06

(52) U.S. Cl. ..... 242/178; 242/477.3; 242/478.2; 242/486.3

(58) Field of Search ..... 242/477.1, 478.2, 242/477.3, 486.3, 178

(56) References Cited

U.S. PATENT DOCUMENTS 4,515,320 A * 5/1985 Slavik et al. ..... 242/478.2
4,667,889 A * 5/1987 Gerhartz ..... 242/477.6
4,697,753 A * 10/1987 Schippers et al. ..... 242/477.6
5,639,037 A * 6/1997 Marangone et al. . 242/478.2 X
6,027,060 A * 2/2000 Siepmann ..... 242/447.1

FOREIGN PATENT DOCUMENTS

DE 40 24 218 A1 2/1992
DE 42 23 271 C1 6/1993
DE 196 26 962 A1 2/1997
DE 196 40 125 A1 4/1998
EP 0 486 896 B1 5/1995
JP 62-4177 A 1/1987
JP 4-94376 A 3/1992
JP 5-338915 A 12/1993

OTHER PUBLICATIONS

German Search Report.

* cited by examiner

*Primary Examiner*—Michael R. Mansen
*Assistant Examiner*—Minh-Chau Pham
(74) *Attorney, Agent, or Firm*—Kennedy Covington Lobdell & Hickman, LLP

(57) ABSTRACT

A method for producing a cheese, wherein the cheese rotates around its longitudinal axis and the yarn is subjected to a cross-winding movement while being fed to the cheese and wound thereon, and having a crossing angle, a winding angle and a placement distance associated therewith. The method including the steps of controlling the crossing angle and the winding ratio as a function of the cheese diameter during the winding process while controlling the placement distance so that it increases in conjunction with an increasing cheese diameter thereby preventing deformations and improving the production of cheeses. A cheese produced in accordance with the method of the present invention offers advantages for stacking and during transport.

8 Claims, 5 Drawing Sheets

METHOD FOR PRODUCING A CHEESE, AND A CHEESE SO PRODUCED

CROSS-REFERENCES TO RELATED APPLICATIONS

This application claims the benefit of German patent application No. DE 10019734.5 filed Apr. 20, 2000, and German patent application No. DE 10033015.0 filed Jul. 6, 2000, herein incorporated by reference.

FIELD OF THE INVENTION

The present invention relates to a method for producing a cheese which provides for utilizing a predetermined placement distance and controlling the crossing angle and the winding ratio as a function of the cheese diameter, whereby the winding ratio is reduced and the placement distance is increased with an increase in the cheese diameter. The present invention further relates to a cheese so produced having yarn windings arranged so that the crossing angle and the winding ratio are reduced with increasing diameter of the cheese.

BACKGROUND OF THE INVENTION

Cheeses can be produced with random windings, precision windings or progressive precision windings. These types of windings are extensively described, for example, in European Patent Publication EP 0 486 896 B1 or German Patent Publication DE 42 23 271 C1 or in the older, not prepublished German Patent Application DE 100 15 933.

In European Patent Publication EP 0 486 896 B1, winding the yarn is performed by progressive precision winding. In the process of progressive precision winding, the winding is built up in several steps. The frequency of cross winding is reduced in each individual step proportionally with the number of revolutions of the bobbin. Once the smallest, still permissible placement angle has been reached, the cross-winding frequency is suddenly increased. Because of the sudden increase, a new, smaller winding ratio arises. This process is repeated until the predetermined bobbin diameter has been achieved. During winding, the yarn is deposited while taking a placement distance into consideration, wherein it is intended to keep the placement distance as small as possible. Under special conditions, such as, for example where noticeable effects on the position of the windings of the yarn occur in the course of placing the yarn due to changes in tolerances or play in the drive mechanism of the winding device, it is recommended to select a placement distance which is not overly narrow. The placement distance preferably corresponds to the yarn width or the yarn diameter. Pursuant to this method, the predetermined placement distance always remains the same once it is selected.

German Patent Publication DE 42 23 271 C1 also describes the creation of cheeses by means of a progressive precision winding. As in European Patent Publication EP 0 486 896 B1, the selected, predetermined placement distance is intended to be as small as possible and also remains constant.

Both of the publications referenced above relate to methods for avoiding working with "dangerous mirror pattern values" in which the yarn lies on top of itself from one layer to layer and the disadvantages during bobbin building associated therewith.

German Patent Publication DE 40 24 218 A1 is representative of the state of the art and discloses a method for controlling the cross-winding speed during the production of a cheese so that the crossing angle changes at least approximately steadily as a function of the bobbin diameter from a selectable value in the first yarn layer to a selectable final value in the last yarn layer, and that simultaneously, the winding ratio or spooling ratio, also changes at least approximately steadily from an initial value in the first yarn layer to an end value in the last yarn layer. As in the random winding method, the method includes a steady change of the winding ratio. However, in contrast to the random winding method, the amount of the change of the winding ratio is freely selectable or controllable with a steady change of the crossing angle. In accordance with this method, a whole-number winding ratio, and therefore the appearance of the disadvantageous winding patterns or mirror patterns associated therewith, is intended to be either avoided or rapidly passed through.

Further, not prepublished German patent application DE 100 15 933 describes a method for controlling the crossing angle and the winding ratio so that it is possible to achieve an excellent unwinding behavior of the cheese. During the production process of the cheese, there are a number of requirements, such as flat front faces or maintaining a constant winding tension, which are desirable. However, in order to meet these requirements without impairing the stability or desired shape of the cheese due to blooming, it is necessary control the crossing angle and the winding ratio within narrow limits. Thus, a large outlay in equipment and controls, such as, the employment of a winding tension control, must be provided.

In order to prevent deformations in the edge area or of the front face of the cheese, it is typical to permit a bobbin build-up at the edge having a slightly conical shaped front face. It is known to create this conical shape by the axial extension of the winding of the cheese, which decreases with increasing bobbin diameter and is hereinafter referred to as "bobbin traverse". With increasing bobbin diameters, the bobbin traverse is affected in that the distance between the clamping line and the yarn guide becomes greater, and thus, the reversing points during the placement of the yarn wander inward thereby causing the reduction of the bobbin traverse when the bobbin diameter increases. While a cheese production process resulting in slightly conical front faces helps to prevent deformations of the cheese, there are disadvantages in stacking and transporting finished cheeses with slightly conical front faces. During stacking and transporting, the cheeses are typically set up so that their axes of rotation are in a vertical position and the yarn bodies must support the weight of the pallets located on top of them. Therefore, while the conical shape of the front faces may be acceptable, or even actively created, for the reasons set forth above, the conical shape of the front faces clearly limits the options, or the load-bearing capability of the cheeses, during stacking and transport of the pallets. It is also very disadvantageous that an increasingly conical shape of the front face, or a trapeze-shaped cross section, of the cheese is present in conjunction with a reduction of the bobbin volume, or of the yarn body thereby resulting in a considerable reduction in the running length of the bobbin.

Moreover, blooming can occur in spite of conically shaped front faces, particularly with cheeses of large diameters, for example, cheeses having diameters of more than 300 mm. While it is possible to counter blooming during constantly maintained winding tension by increasing the crossing angle, such action causes the bobbin traverse to become even smaller and further reduces the bobbin volume. Alternatively, blooming can be counteracted by lowering the winding tension. However, in cases where paraffin is applied to the yarn, it is known that a constant winding tension is a prerequisite for a uniform paraffin application to the yarn. Thus, the lowering of the winding tension, at least in connection with cases where paraffin must be applied, does not represent a satisfactory solution. Further, reducing the winding tension in the manner performed in accordance with the known prior art can lead to the winding tension in cheeses with large diameters to become so low at the end of the bobbin travel, that tangled, or unstable layers are created. However, if the winding tension is appropriately increased at the start of the bobbin travel in order to prevent the reduction to too small winding tension, the danger of too high a winding tension at the start of the bobbin travel exists. In any case, the winding tension is not uniform.

When drawing the yarn off feeder rolls in a constant manner, such as is the case during open-end spinning, a decreasing bobbin traverse leads to a reduction of the winding tension when the bobbin diameter is increased. Therefore, the constant winding tension required for uniform paraffin application to the spun yarn is no longer met. A constant winding tension can be achieved again by reducing the crossing angle as the bobbin diameter increases. Although it is possible to maintain the winding tension and the achieve a substantially uniform paraffin application in this manner, deformations of the cheese will likely result due to the reduction of the crossing angle.

Thus, while a reduction of the crossing angle is employed in connection with the known prior art in rigid placement systems, i.e. at a constant cross-winding traverse of the yarn guide, in order to maintain the desired bobbin traverse, there are disadvantages, as discussed above, associated with employing such a reduction.

OBJECT AND SUMMARY OF THE INVENTION

It is an object of the present invention to overcome the disadvantages described above by providing an improved method for the production of cheeses and a cheese so produced.

In accordance with the present invention, an improved method for producing a cheese is provided for a cheese having a yarn body and being rotational around its longitudinal axis in which the yarn is subjected to a cross-winding movement while being fed to the cheese and wound thereon, and whereby the winding process includes a crossing angle and a winding angle associated therewith. More particularly, the method includes determining a placement distance, controlling the crossing angle and the winding ratio as a function of the cheese diameter wherein the winding ratio is reduced as the cheese diameter is increased, and controlling the placement distance so that the placement distance increases as the cheese diameter increases.

By applying the method of the present invention which provides for controlling the placement distance so that it increases with increasing cheese diameter, the conicity of the front faces of the cheese can be advantageously reduced or eliminated without blooming or similar disadvantages occurring, and without the necessity of an additional large outlay in equipment.

In the method of the present invention, the density of the yarn body of the cheese is preferably reduced as the bobbin diameter is increased. Thus, the present invention effectively prevents the pressure on the inner layers of the cheese from becoming so strong that deformations of the cheese occur.

A preferred embodiment provides for the density of the yarn body to be matched to a predetermined progression of the density values over the cheese diameter. Matching is performed by a correspondingly controlled change of the placement distance. During the matching process, an allocation of the crossing angle, the density value and the placement distances takes place. Through such allocation, a simple and effective control becomes possible.

In accordance with the method of the present invention, the drive of the cheese and the cross-winding movement are actuated by drive elements which can be separately adjusted.

Preferably, the crossing angle is controlled so that it is reduced as the cheese diameter is increased and the placement distance is increased in accordance with the present invention, thereby producing a cheese with flat front faces by means of a reduction of the crossing angle, without increasing the pressure on the inner layers of the cheese. Because the reduction of the crossing angle in this manner does not increase the pressure on the inner layers of cheese, the deformations, or blooming, particularly at the front face of the cheese, typically caused by a reduction of the crossing angle are avoided. Utilizing the method of the present invention, improved cheeses can be produced on winding heads which are operated at open-end spinning frames with constant yarn draw-off. The volume of the cheese, as well as the running length, are advantageously increased by flat front faces. Thus, the present invention provides a method for preventing the decrease of the bobbin traverse and reduction of the accompanying winding tension which utilizes a reduction of the crossing angle whereby the winding tension is kept substantially constant and thereby permitting uniform paraffin application to the yarn.

The present invention advantageously provides for the reduction of the crossing angle utilizing a rigid placement system for generating the cross-winding movement of the yarn, such as, by way of example, a reverse yarn guide whereby the bobbin traverse can be maintained in the desired amount without causing deformations, or blooming, of the cheese.

In the method of the present invention, the determination of the placement distance is readily calculated by means of the following mathematical equation:

$$s=d_v+E_0+f(D),$$

wherein s=placement distance $d_v$=preset yarn diameter $E_0$=base value for the free space between two yarn windings deposited at the placement distance f(D)=a value depending on the diameter of the cheese.

In addition, the following mathematical equation is used to include possible fluctuations of the yarn diameter:

$$s_n = \frac{d_n + d_{nw}}{2} + E_n$$

The following applies for $E_n$:

$$E_n=E_0+b\times(D-D_0),$$

wherein:

$s_n$=placement distance after the nth winding $d_n$=yarn diameter of the nth winding $d_{nw}$=yarn diameter of the yarn winding placed at the placement distance $s_n$ after the nth winding $E_0$=base value for the free space between two yarn windings deposited at the placement distance $E_n$=free space between the yarn windings of the nth winding and the following winding b=factor to be established D=diameter of the cheese $D_0$=diameter of the bobbin case In a variation of the method of the present invention, values stored in the form of tables in a data memory are used to establish the progression of the density values, as well as the determination of the placement distance. In use, the stored data may be empirically determined, or may represent experimental values.

A precise measurement of the density of the yarn body of the cheese may be calculated by means of a control, wherein the actual yarn diameter is measured and the calculation of the actual placement distance is performed so that the effect of the fluctuations of the yarn diameter on the free space between the windings of the yarn is compensated.

The method in accordance with the present invention readily provides for the maintenance of the winding tension within narrow tolerances which permits a substantially uniform paraffin application to the yarn while simultaneously permitting the lateral surfaced to extend substantially perpendicularly to the axis of rotation without a danger of deformation in bobbin building. Thus, the present invention advantageously increases the volume and the running length of the cheese.

In addition, the present invention provides further advantages in stacking and during transporting the finished cheeses. Specifically, the useful support surface of cheese produced or built in accordance with the present invention is improved because the lateral surface is substantially flat thereby increasing the load-bearing capability and stability of a transport arrangement consisting of pallets equipped with such cheeses.

Further details, features and advantages of the present invention will be disclosed in and understood from the following disclosure of one or more preferred embodiments of the present invention with reference to the accompanying drawings.

DETAILED DESCRIPTION OF THE PREFERRED EMBODIMENT

Figure 1:
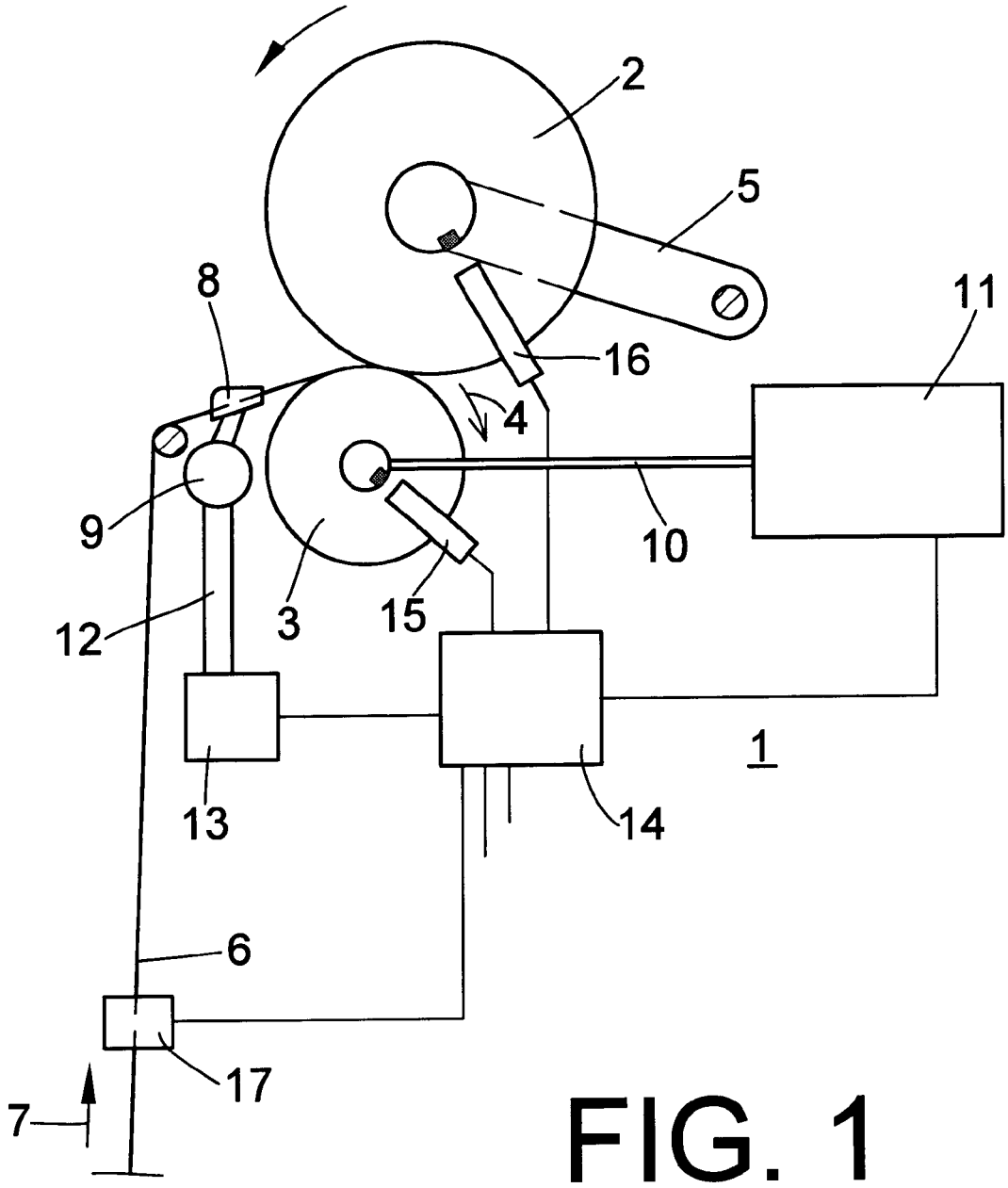
FIG. 1 is a side elevational view of a winding head with a yarn diameter measuring device in accordance with the present invention.

Referring now to the accompanying drawings and specifically to FIG. 1, a cheese 2 in a winding device 1 of a winding head for producing cheeses is driven by means of a friction roller 3 rotating in the direction of the arrow 4. As shown, the cheese 2 is seated in a pivotable creel 5 and rests on the friction roller 3. Because of the abutting relationship, the cheese 2 and the friction roller 3 form a clamping spot. In operation, a yarn 6 is fed in the direction of the arrow 7. The yarn 6 passes a cross-winding yarn guide 8 and is wound on the cheese 2. The driving of the yarn guide 8 is performed by means of a cross-winding device 9. The friction roller 3 is driven via the shaft 10 by means of a motor 11. As shown in FIG. 1, the cross-winding device 9 is connected by means of a active connector 12 to a motor 13. In the preferred embodiment, the motor 11, as well as the motor 13, are controlled by a microprocessor 14. Pursuant to the method of the present invention, the microprocessor 14 includes a program for controlling the placement distance as a function of the actual cheese diameter. The actual cheese diameter is calculated from the length of yarn wound on the cheese 2. The yarn length is determined with the aid of a sensor 15, which detects the revolutions of the friction roller 3 and is connected to the microprocessor 14. A sensor 16 is used for determining the number of revolutions of the cheese 2 and is also connected with the microprocessor 14.

In use, a measuring head 17 detects the actual yarn diameter d and is also connected to the microprocessor 14.

Figure 2:
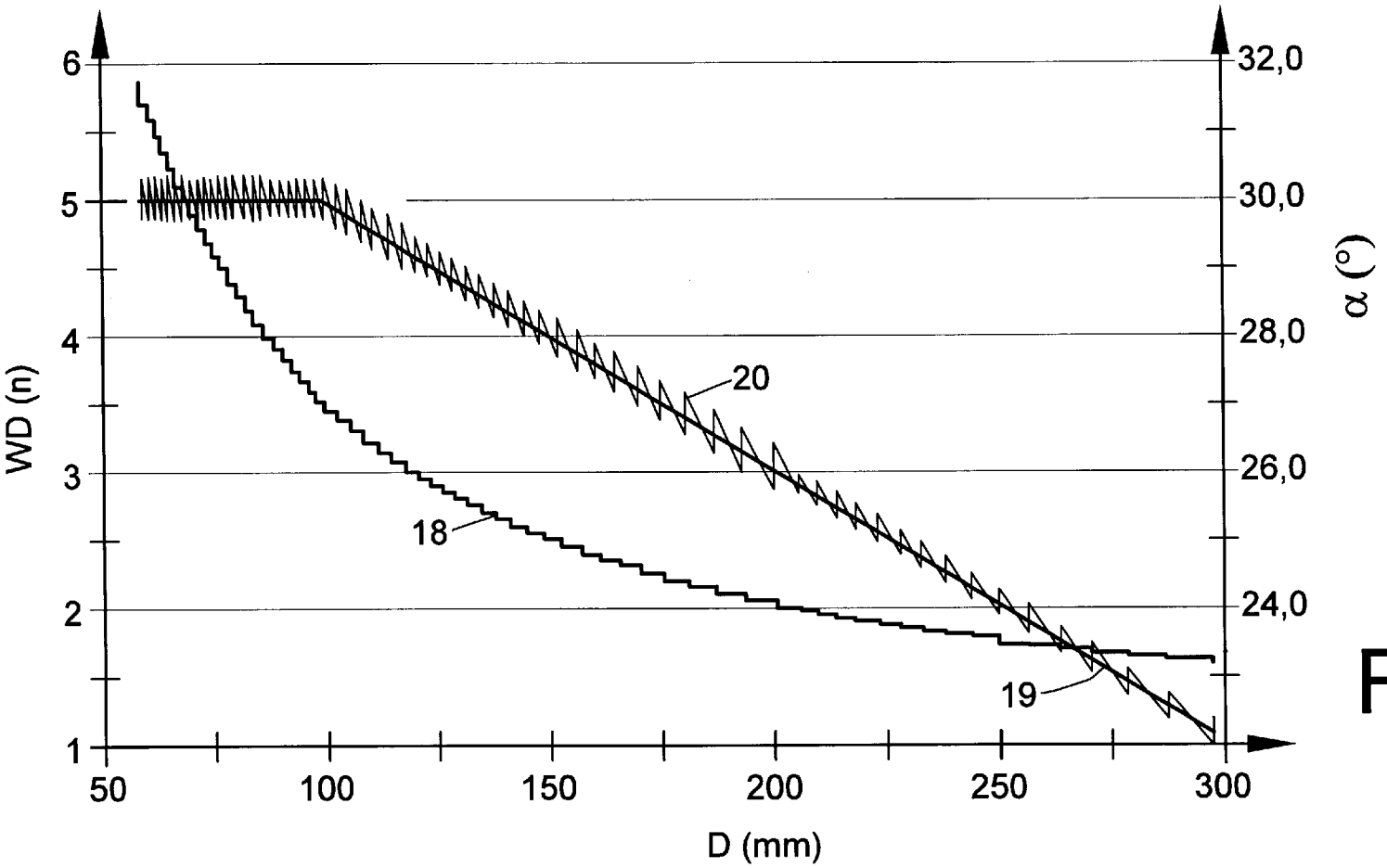
FIG. 2 is a graphic illustration of a progression of the winding ratio and crossing angle over the cheese diameter.

Turning now to FIG. 2, a graphical example is shown of a progression of the winding ratio WD and crossing angle $\alpha$ in the course of producing the cheese 2 as a function of the cheese diameter D, wherein the crossing angle $\alpha$ and the winding ratio WD are approximately continuously reduced with the increase in the cheese diameter D, and the placement distance is simultaneously increased. The method of the present invention is advantageously employed when a rigid placement system is used for generating the crossing motion, such as, by way of example, a reverse gear yarn guide. In the preferred embodiment, the value of the winding ratio WD is reduced in steps from the start to the finish of the bobbin travel in a known manner known and approximately forms a curve 18. As shown in FIG. 2, the nominal crossing angle $\alpha_{SOLL}$ is constantly maintained at the value $\alpha_{SOLL}$=30 degrees up to a cheese diameter D of D=100 mm, and is linearly and steadily reduced from D=100 mm to D=300 mm from $\alpha_{SOLL}$=30 degrees to $\alpha_{SOLL}$=22 degrees. The course of the nominal crossing angle $\alpha_{SOLL}$ in the preferred embodiment is described by the following equation:

$$\alpha_{SOLL}=34-0.04\times D.$$

In FIG. 2, the curve 19 illustrating the course of the nominal crossing angle $\alpha_{SOLL}$ is represented by a heavy line, while the discontinuous course 20 of the curve of the actual crossing angle $\alpha_{IST}$, which is matched to the stepping of the winding ratio WD, is illustrated by a thin line. In the preferred embodiment, the reduction of the crossing angle $\alpha$, in conjunction with a simultaneous increase of the placement distance, advantageously increases the volume of the cheese 2 without causing blooming at the front face of the cheese 2.

Figure 3:
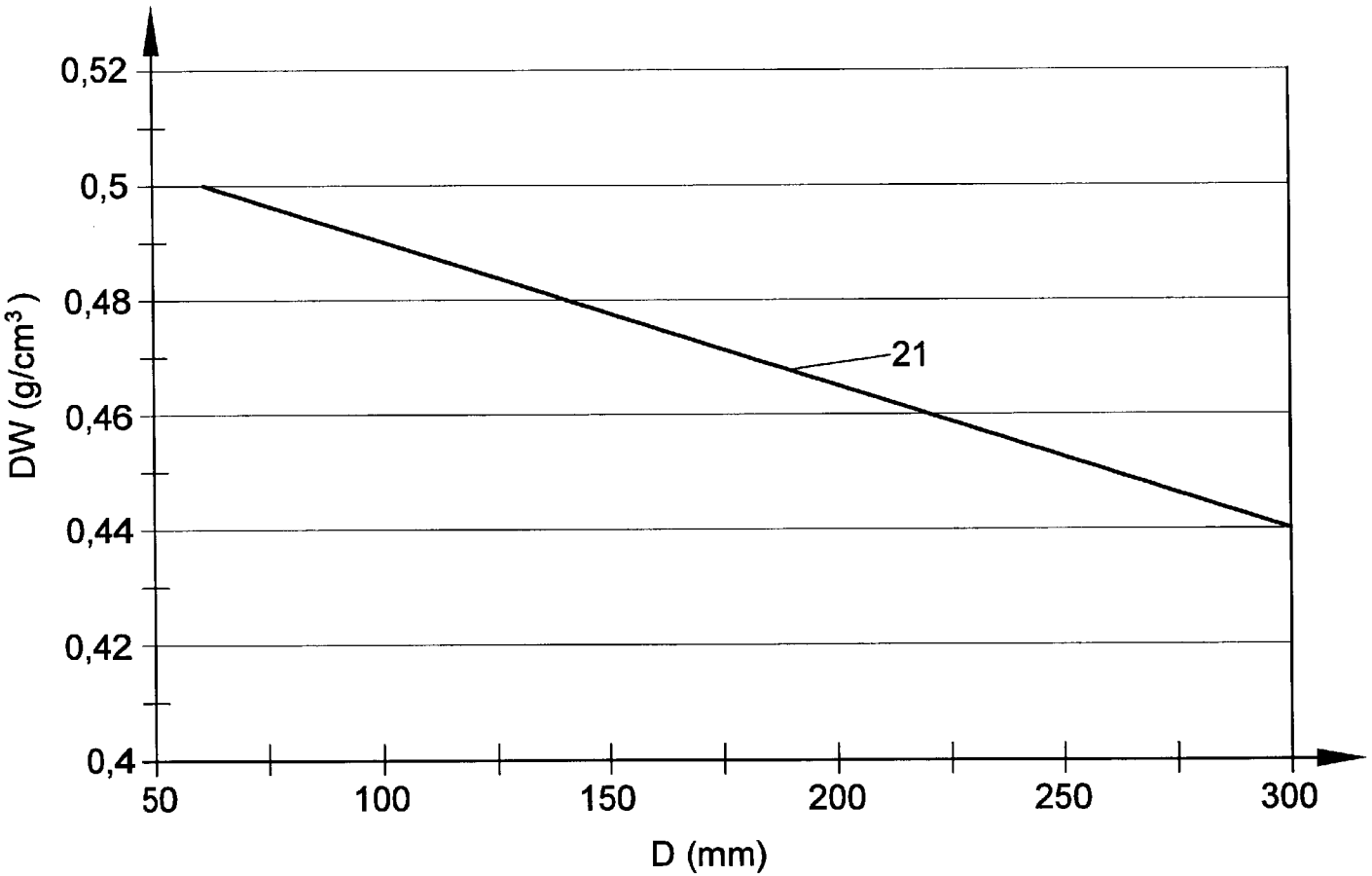
FIG. 3 is a graphic illustration of the predetermined progression of the density of the cheese.

The predetermination of the density DW of the yarn body of the cheese 2 in the preferred embodiment is graphically illustrated in FIG. 3. The curve 21, illustrated as a straight line, represents the density value of the respective cheese diameter D which, as shown, decreases proportionally with the cheese diameter.

The predetermined progression of the density in the preferred embodiment can be calculated in accordance with the following equation:

$$DW=0.515-2.5\times10^{-4}\times D$$

The measuring head 17 detects the yarn diameter $d_n$. The calculation of the position at which the point of the yarn 6 of a yarn diameter $d_n$ is placed on the circumference of the cheese 2 may be determined, such as, by way of example, by means of a continuous measurement of the length of the yarn 6. The placement distance $s_n$ for this position can be calculated by means of the following equation:

$$s_n = \frac{d_n + d_{nw}}{2} + E_n$$

wherein $$E_n = E_0 30\ b \times (D - D_0).$$

In applying the above equation, a value of $E_0$=0.3 mm, for example, can be selected for the base value $E_0$ of the free space between the yarn windings. At the start of the bobbin travel $D=D_0$, and therefore $E_0=E_n$. Thus, the free space $E_n$ increases with an increasing cheese diameter D and at the end of the bobbin travel can have reached a value of, for example, 1.8 mm.

Figure 4:
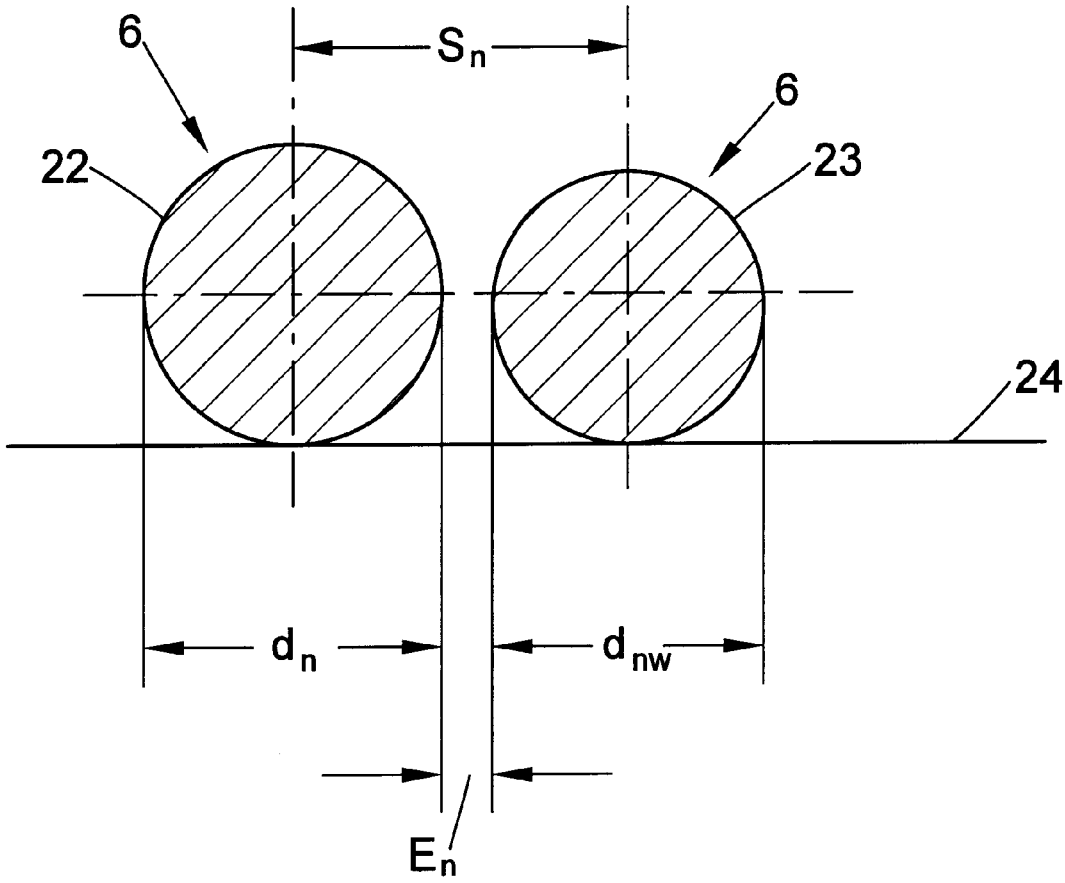
FIG. 4 is a schematic sectional view of the position of windings of the yarn placed at the actual placement distance.

Referring to FIG. 4, the yarn diameter $d_{nw}$ identifies the diameter of the yarn 6 at a position 23. The yarn 6 is subsequently placed at the placement distance $s_n$ adjacent to another yarn 6 at a position 22 having a yarn diameter $d_n$. $E_0$ is a value for the entire bobbin travel, which is maintained constant. After the yarn diameter $d_{nw}$ has been detected, it is possible to determine the placement distance $S_n$ on the circumference of the cheese 2. The yarn 6 may be placed in a controlled manner on previously wound layers or, as shown in FIG. 4, at the start of the bobbin travel on the surface of a bobbin case 24, in such a manner that the position 23 comes to rest at the placement distance $S_n$ with respect to the position 22 on the circumference of the cheese 2. To show a diameter difference clearly, the yarn 6 is illustrated with exaggerated different diameters in FIG. 4. Diameter deviations, which in actuality occur between the windings of the yarn, are considerably less and would not be visible to the unaided eye in a representation to scale. Deviations from the predetermined theoretical yarn diameter $d_v$ have the effect that larger yarn diameters cause a correspondingly larger placement distance, and smaller yarn diameters cause a correspondingly lesser placement distance.

In accordance with the preferred embodiment, the density of the yarn body of the cheese 2 can be determined in the following manner:

The run length of the yarn 6 wound on the cheese 2 is continuously measured. The actual weight of the yarn body of the cheese 2 can be calculated on the basis of yarn-specific diameters.

For example, the actual cheese diameter D is calculated in accordance with the equation $$D = \frac{n_{FW} \times D_{FW}}{n_{SP}}$$

The numbers of revolutions required for the calculation, namely the number $n_{SP}$ of revolutions of the cheese 2 and the number $n_{FW}$ of revolutions of the friction roller 3, are detected by means of the sensors 15 and 16. The diameter $D_{FW}$ of the friction roller 3 is known. Thus, the actual volume of the cheese 2 can be determined from the calculated actual cheese diameter D, utilizing the also known diameter of the bobbin case 24, and the density DW of the yarn body of the cheese 2 calculated based upon volume and weight. The value of the density DW determined in this manner is compared with the predetermined nominal value for the respective diameter D of the cheese 2. The result of this comparison is used for controlling the placement distance $S_n$ as a function of the cheese diameter D. In an alternate embodiment of the method of the present invention, the nominal values of the density DW assigned to the respective cheese diameter D are predetermined in the form of tables and stored in a data memory.

Figure 5:
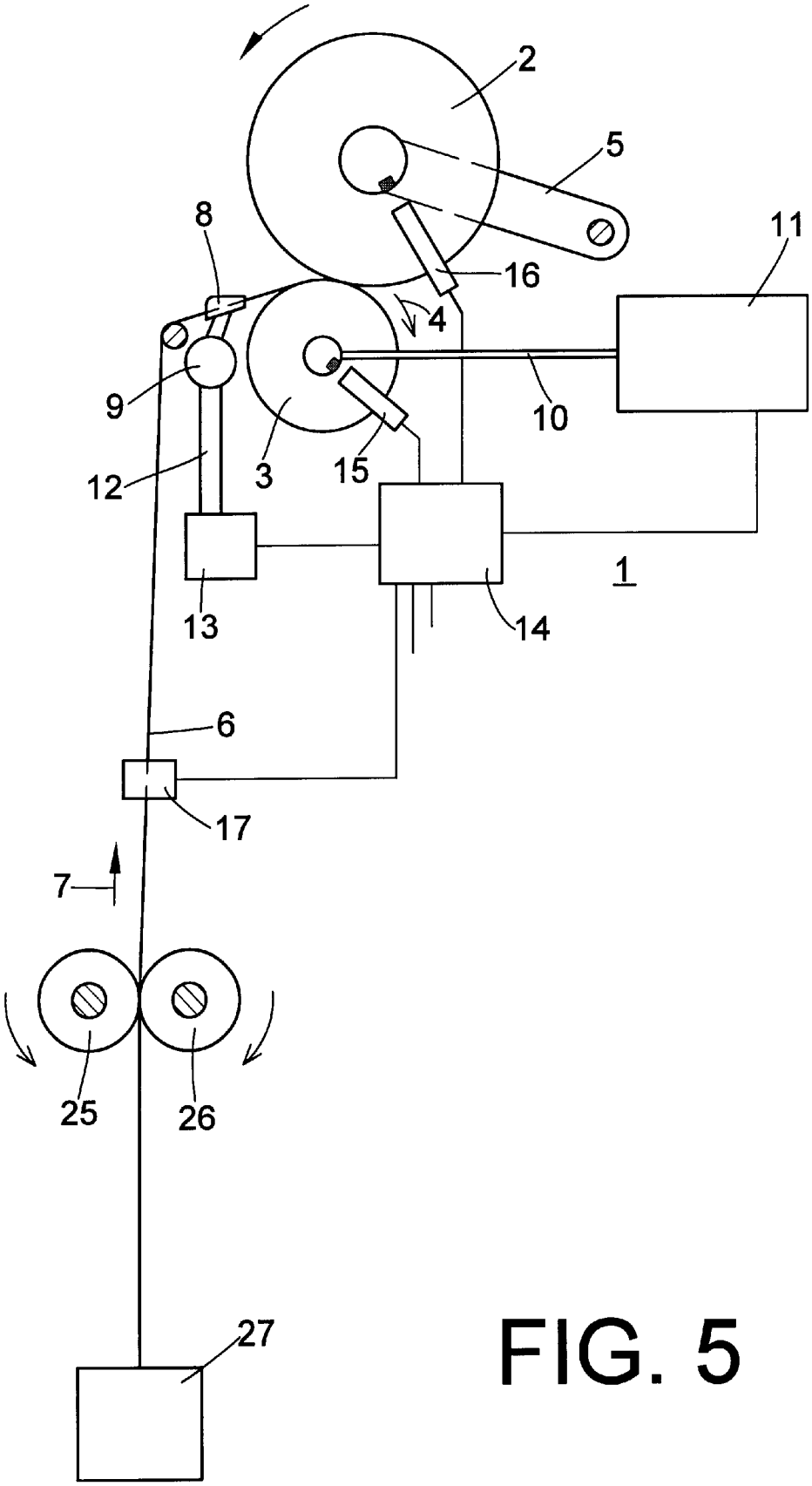
FIG. 5 is the winding head shown in FIG. 1 in an open-end spinning frame.

In FIG. 5, the winding head of FIG. 1 is shown employed in an open-end spinning frame. The yarn 6 is drawn off by the draw-off rollers 25, 26 from the feed unit 27, which is designed as a spinning box. Because the bobbin traverse is typically reduced with increasing cheese diameter D, the front face of the cheese may have a slightly conical shape in the course of winding the yarn 6 on the one hand while on the other hand, the winding tension will decrease if no steps for counteracting the decrease are taken. The winding process of the preferred embodiment addresses this problem and provides for controlling the winding ratio WD, the crossing angle α and the density DW in accordance with the diagrams shown in FIGS. 2 and 3 by means of the control device, such as, by way of example, a microprocessor. Thus, the reduction in the bobbin traverse can be stopped by decreasing the crossing angle α to produce cheeses in so that they have flat front faces. Further, the winding tension is kept constant to a large degree and in this manner permits a uniform paraffin application to the yarn 6. Disadvantageous effects such as blooming, for example, which can be caused by the winding tension remaining constant with an increasing cheese diameter D, as well as by a reduced crossing angle α with an increasing cheese diameter D, are avoided by the method in accordance with the present invention, wherein the placement distance is controlled in such a way that it increases with increasing cheese diameter D.

In the preferred embodiment, the winding tension remains constant and has a relationship to the crossing angle α via cos α. In addition, the winding tension is a function of a number of further factors. Therefore, the present invention provides a improved method for producing cheeses by means of the controlled reduction of the density DW of the cheese 2 through an increase of the placement distance whereby the cheese diameter D may be increased without increasing the pressure on the inner layers of the cheese to a level which would cause deformations of the cheese to occur.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for producing a cheese having a yarn body, wherein the cheese rotates around its longitudinal axis and the yarn is subjected to a cross-winding movement while being fed to the cheese and wound thereon, and having a crossing angle and a winding ratio associated therewith, the method comprising the steps of: determining a placement distance; controlling the crossing angle and the winding ratio as a function of the cheese diameter wherein the winding ratio is reduced as the cheese diameter is increased; and controlling the placement distance so that the placement distance increases as the cheese diameter increases.

2. The method in accordance with claim 1, wherein the step of controlling the placement distance comprises decreasing the density of the yarn body of the cheese as the cheese diameter increases.

3. The method in accordance with claim 1, wherein the step of controlling the placement distance comprises matching the density of the yarn body of the cheese to a predetermined progression of the density value over the cheese diameter.

4. The method in accordance with claim 1, wherein the step of controlling the crossing angle comprises decreasing the crossing angle as the cheese diameter increases.

5. The method in accordance with claim 1, wherein the step of determining the placement distance is performed utilizing a mathematical function.

6. The method in accordance with claim 1, further comprising the steps of: measuring the actual yarn diameter; and calculating the actual placement distance and including the effect of fluctuations of the yarn diameter on the free space between two yarn windings.

7. A cheese having a yarn body wound about a longitudinal axis in a cross-winding manner at a crossing angle, a winding ratio and a placement distance associated therewith, the cheese comprising yarn windings arranged so that the crossing angle and the winding ratio decrease with an increasing cheese diameter and the placement distance increases with an increasing cheese diameter.

8. The cheese in accordance with claim 7, wherein the density of the yarn body of the cheese decreases with an increasing cheese diameter.

* * * * *